US006923107B2

(12) United States Patent
Zurek et al.

(10) Patent No.: US 6,923,107 B2
(45) Date of Patent: Aug. 2, 2005

(54) ARMORED VEHICLE, ESPECIALLY COMBAT TANK

(75) Inventors: Rudolf Zurek, Gröbenzell (DE); Gerhard Heise, München (DE)

(73) Assignee: Krauss-Maffei Wegmann GmbH & Co. KG (DE)

( * ) Notice: Subject to any disclaimer, the term of this patent is extended or adjusted under 35 U.S.C. 154(b) by 0 days.

(21) Appl. No.: 10/483,100

(22) PCT Filed: Jan. 10, 2003

(86) PCT No.: PCT/DE03/00056

§ 371 (c)(1),
(2), (4) Date: Jan. 7, 2004

(87) PCT Pub. No.: WO03/062737

PCT Pub. Date: Jul. 31, 2003

(65) Prior Publication Data

US 2004/0154464 A1 Aug. 12, 2004

(30) Foreign Application Priority Data

Jan. 26, 2002 (DE) ..... 102 03 021

(51) Int. Cl.[7] ..... F41H 7/02
(52) U.S. Cl. ..... 89/36.08; 180/68.6; 293/115
(58) Field of Search ..... 89/36.08; 180/68.6; 293/115

(56) References Cited

U.S. PATENT DOCUMENTS 2,236,461 A * 3/1941 Belaieff et al. ..... 89/36.08
2,374,240 A * 4/1945 Shankman ..... 180/9.62
2,376,331 A * 5/1945 Abrams ..... 89/36.08
2,397,809 A * 4/1946 Roeder et al. ..... 89/36.13
4,186,817 A * 2/1980 Bauer ..... 180/68.1
4,325,283 A * 4/1982 Bemiss ..... 89/36.07
4,326,445 A * 4/1982 Bemiss ..... 89/36.08
4,492,282 A * 1/1985 Appelblatt et al. ..... 180/68.1
4,598,785 A * 7/1986 LeBlanc ..... 180/68.1
5,753,847 A * 5/1998 Middione et al. ..... 89/36.08
5,780,761 A * 7/1998 Musante et al. ..... 89/36.08
5,880,394 A * 3/1999 Kim ..... 89/36.02

* cited by examiner

*Primary Examiner*—Michael Carone
*Assistant Examiner*—Troy Chambers
(74) *Attorney, Agent, or Firm*—Robert W Becker & Associates; Robert W Becker

(57) ABSTRACT

An armored vehicle, especially combat vehicle, having an outer wall (1) in which is disposed an air inlet opening (2) behind which a radiator is positioned in the interior of the vehicle. To produce a ballistic protective device at the air inlet opening, there is disposed in the interior of the vehicle, in the region between radiator and air inlet opening (2), a base plate (5), and the intermediate spaces between the outer edges of the base plate (5) and the inner edges of the air inlet opening (2) are closed off by cover plates (4.2, 4.3). The base plate (5) is provided in the central portion with an air passage below which the radiator is positioned. Above the base plate (5), essentially in the plane of the outer wall (1), a protective plate (7) is disposed and dimensioned such that an annular air passage slot is provided between its outer edges and the inner edges of the air inlet opening (2).

11 Claims, 7 Drawing Sheets

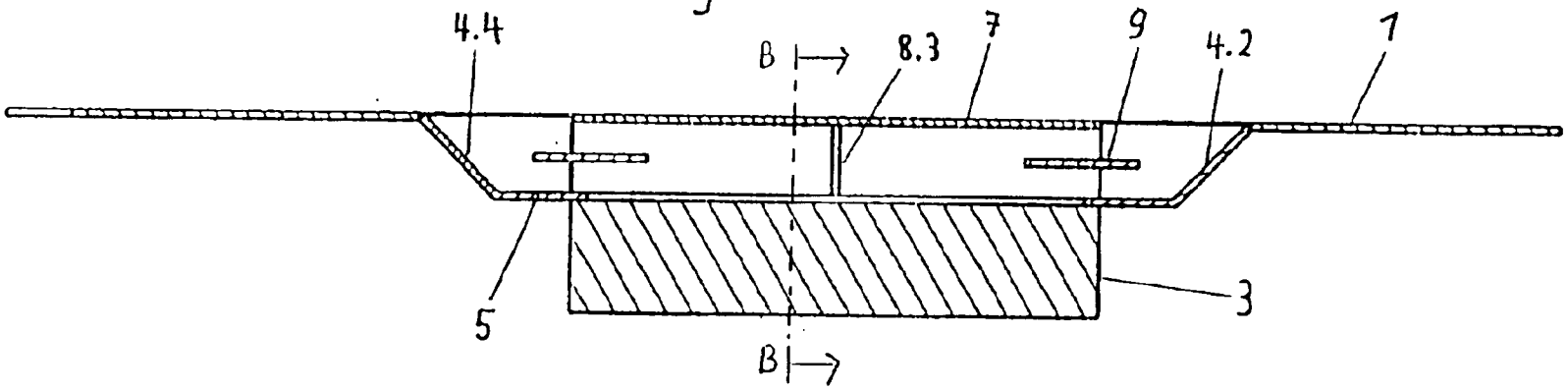
Fig. 7 (A-A)
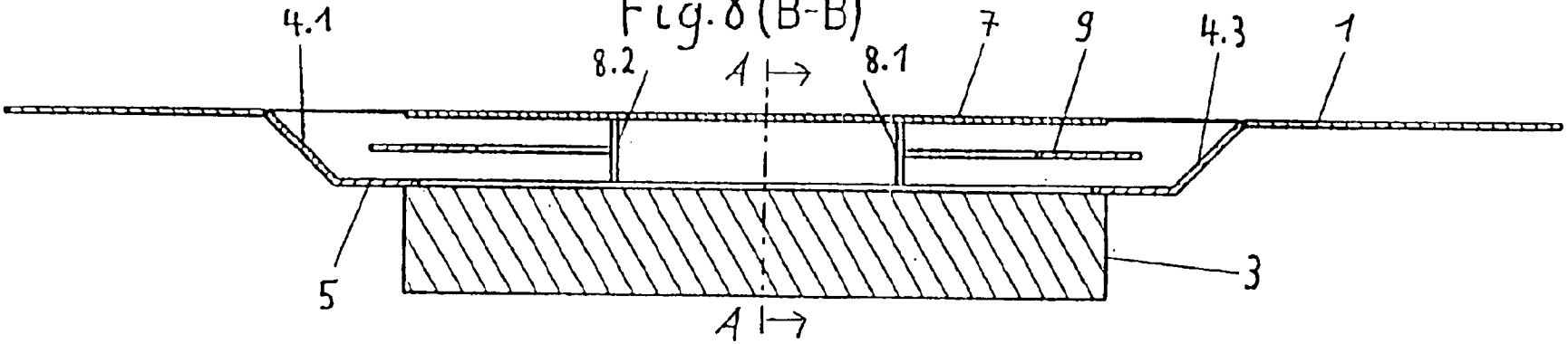
Fig. 8 (B-B)

ARMORED VEHICLE, ESPECIALLY COMBAT TANK

BACKGROUND OF THE INVENTION

The invention relates to an armored vehicle, especially a combat or military vehicle, having an outer wall in which is disposed an air inlet opening, behind which a radiator is positioned in the interior of the vehicle, whereby the air inlet opening is provided with a ballistic protective device.

With known armored vehicles, the ballistic protective devices are formed at the air inlet opening in general as so-called gratings, which has the drawback that the ballistic effects are a function of direction, and the radar signatures are conspicuous. It is also known to dispose respective cover plates over the air inlet openings, whereby the air enters from the side below the cover plates, which has the drawback that the vehicle roofs must be raised.

It is an object of the invention to provide an armored vehicle, especially a combat or military vehicle, having the features described initially in such a way that on the one hand an adequate supply of air is ensured, and on the other hand, however, a high ballistic protection and a low radar and IR signature can be achieved.

SUMMARY OF THE INVENTION

This object is inventively realized in that in the interior of the vehicle, in the region between the radiator and the air inlet opening, there is disposed a base plate that extends essentially parallel to the outer wall, and the outer dimensions of which are equal to or smaller by a prescribed amount than the dimensions of the air inlet opening, and the intermediate spaces between the outer edges of the base plate and the inner edges of the air inlet opening are closed off by cover plates that form a closed ring, and the base plate is provided in the central portion with an air passage, below which the radiator is positioned, and the recessed area formed by the base plate and the cover plates is partially covered by a protective plate, the dimensions of which, at least along partial portions of its outer edges, are smaller than the dimensions of the air inlet opening yet greater than the dimensions of the air passage in the base plate, and which is disposed essentially in the plane of the outer wall. Advantageous further developments of the invention are described subsequently and in the dependent claims.

The basic concept of the invention is to cover the air inlet opening, with the exception of at least two open air passage slots that permit air to enter, with a protective plate that is embodied as an armored plate and is essentially flush and parallel with the surrounding vehicle contour.

Disposed below this protective plate is a base plate that is provided in the central portion with an air passage, below which is positioned the radiator. Since the protective plate overlaps the air passage in the base plate, a ballistic seal is ensured at all angles of threat. Furthermore, plates can be disposed in the edge region that extend parallel to the covering protective plate and that at the same time are used for producing a flow distribution that is balanced out over the air inlet opening. The space below the covering protective plate is divided by partitions that are essentially perpendicular to the protective plate in such a way that at least two volumes associated with the aforementioned air passage slots result. The partitions can be connected to the covering protective plate and can be disposed either spaced from or flush with the following air guidance elements. Due to the back venting of the covering protective plate, a low IR signature can be achieved, while a low radar signature results from the planar protective plate that is disposed parallel to the surrounding vehicle structure, and which can be improved still further by radar-absorbing coatings of the air inlet region as well as of the underside of the covering protective plate and of the partitions.

BRIEF DESCRIPTION OF THE DRAWINGS

One embodiment for an armored vehicle pursuant to the invention will be described in greater detail subsequently with the aid of the accompanying drawings.

The drawings show:

FIG. 7, a cross-sectional view through the roof plate with air passage pursuant to FIGS. 1 to 6 taken along the line A—A in FIG. 8;

FIG. 8, a longitudinal cross-sectional view through the roof plate with air passage pursuant to FIGS. 1 to 6 taken along the line B—B in FIG. 7.

DESCRIPTION OF PREFERRED BRIEF EMBODIMENTS

Figure 1:
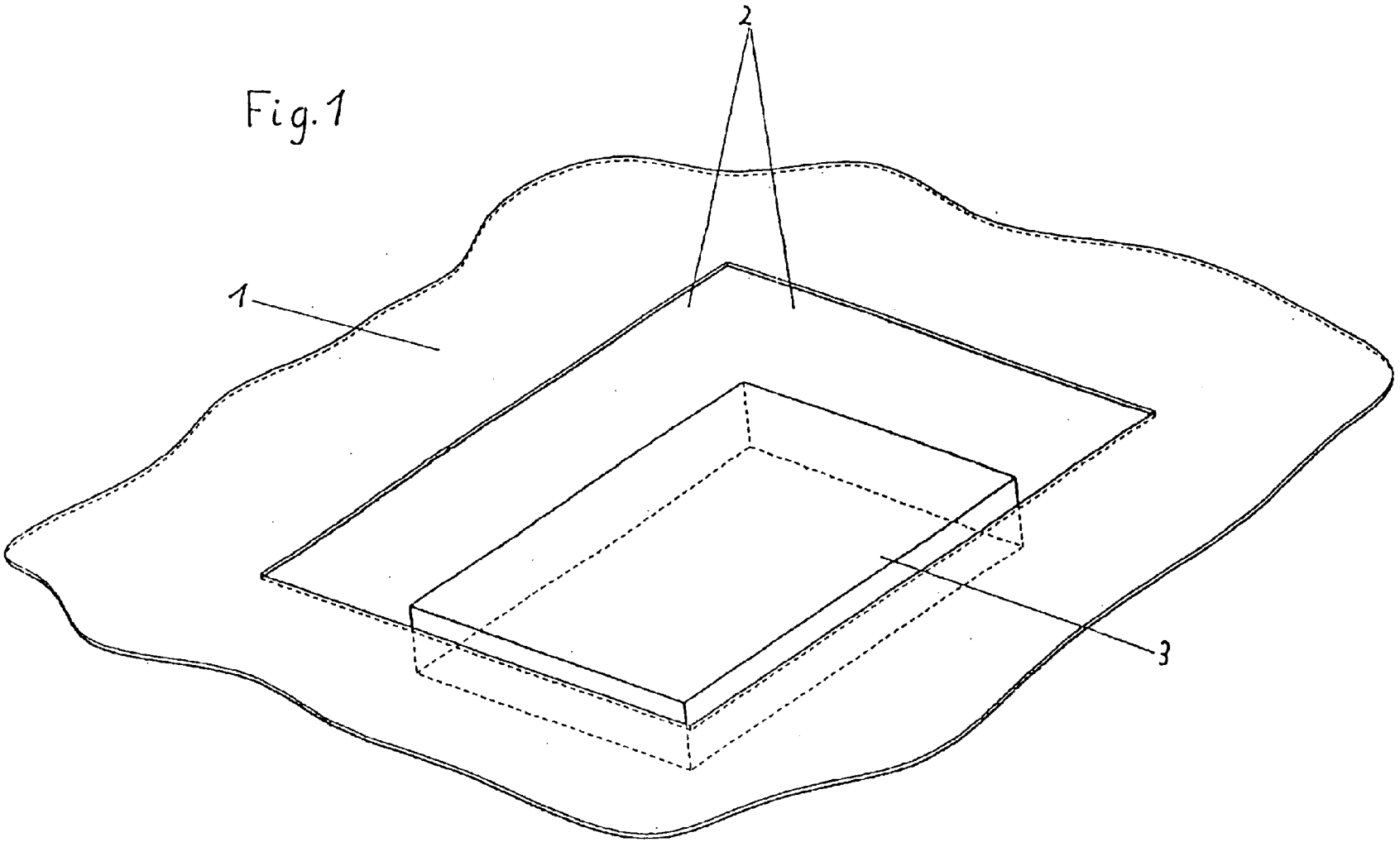
FIG. 1, in an isometric illustration, a portion of the roof plate of an otherwise non-illustrated combat vehicle, showing an air inlet opening and a radiator disposed therebelow.

FIG. 1 shows the starting situation of a roof or top plate of an otherwise not illustrated combat or military vehicle in the region of an air inlet opening. The roof or top plate 1 has a rectangular opening 2, below which is arranged a radiator 3 in the manner indicated. The opening 2 is now to be closed off with a ballistic protective cover.

Figure 2:
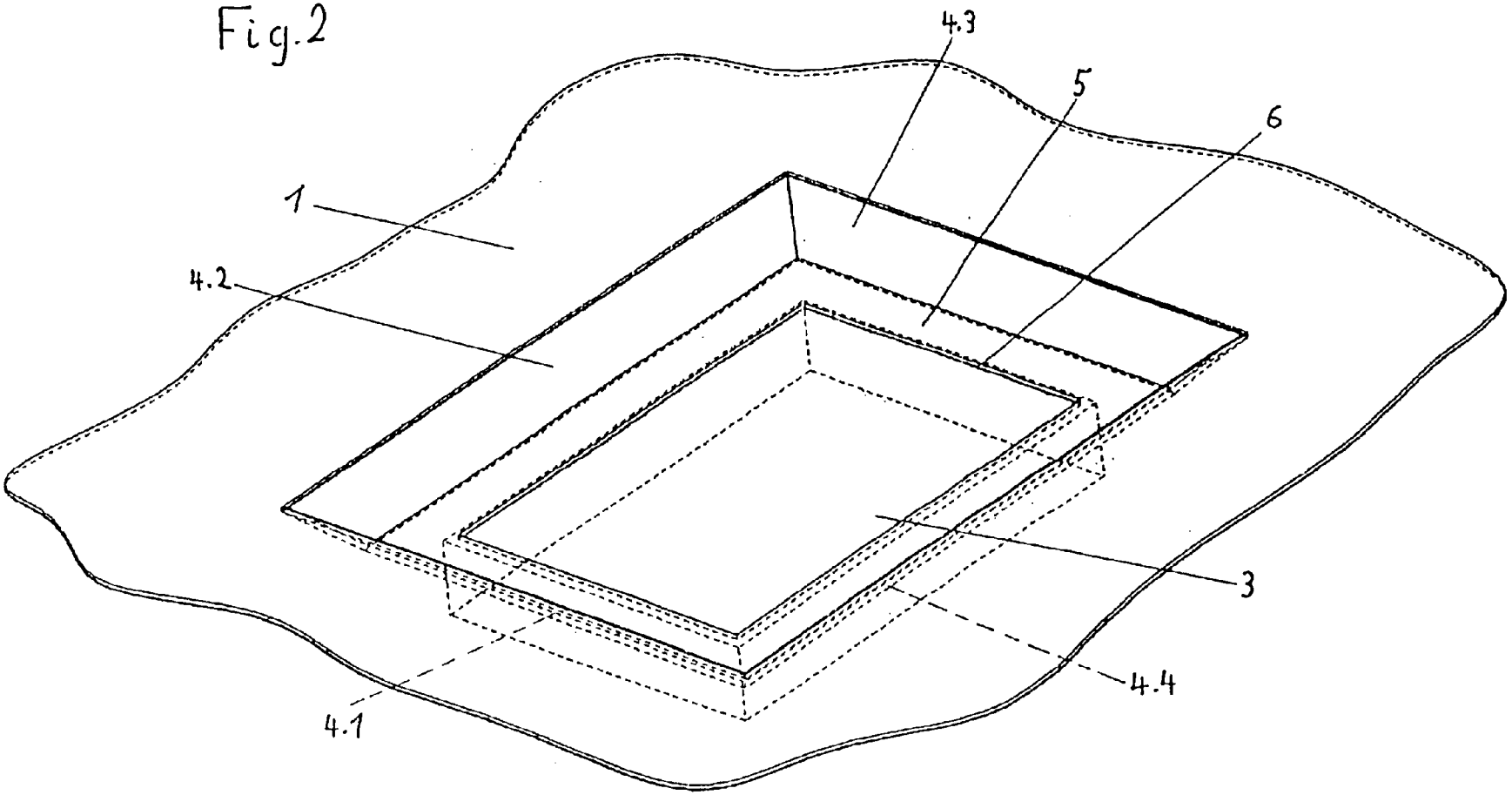
FIG. 2, in an illustration analogous to FIG. 1, the roof plate with the base plate inserted.

For this purpose, as can be seen in FIG. 2, a base plate 5, which extends essentially parallel to the roof plate 1, is disposed in the interior of the vehicle in the region between the radiator 3 and the air inlet opening of the roof plate 1; the outer dimensions of the base plate are slightly less than the dimensions of the air inlet opening 2. Cover plates 4.1, 4.2, 4.3 and 4.4 serve for the mounting of the base plate 5; these cover plates are inserted into the intermediate spaces between the outer edges of the base plate 5 and the inner edges of the air inlet opening 2, and form a closed ring. In this connection, as can be seen in FIG. 2, the cover plates 4.2 and 4.4 drop at a slight angle inwardly toward the central portion of the base plate. In its central portion, the base plate 5 is provided with a rectangular air opening or passage 6, below which is positioned the radiator 3. By means of the cover plates 4.1 to 4.4, the intermediate spaces between base plate 5 and roof plate 1 are completely closed off to the interior of the vehicle.

Figure 3:
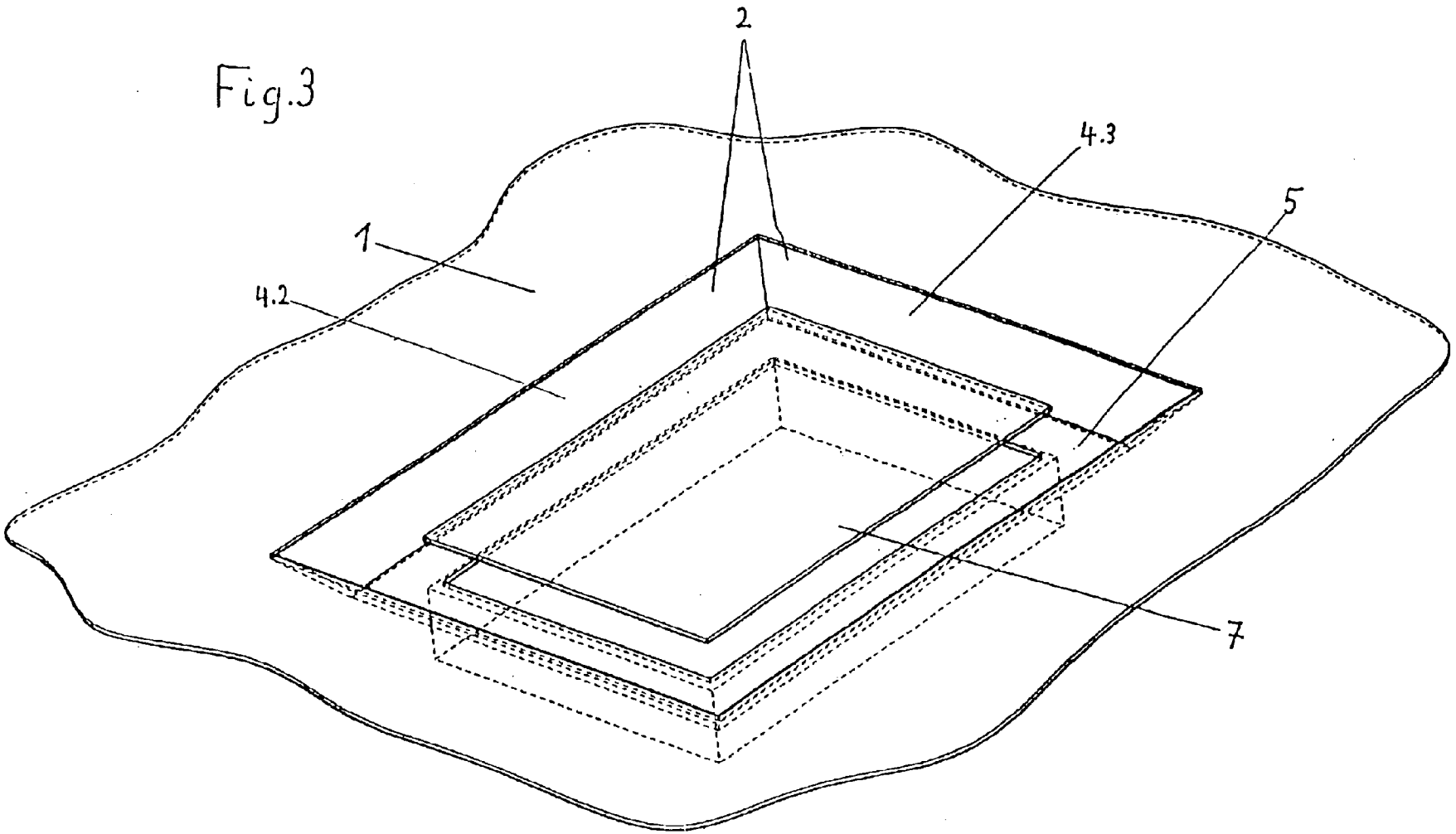
FIG. 3, in an illustration analogous to FIGS. 1 and 2, the roof plate with the base plate inserted and a covering protective plate.

As can be seen in FIG. 3, the recessed area in the contour of the vehicle formed by the base plate 5 and the cover plates 4.1 to 4.4 is now partially covered by a rectangular protective plate 7 in such a way that an on the whole annular passage slot results between the outer edges of the protective plate 7 and the inner edges of the air inlet opening 2. In this connection, the protective plate 7 is disposed in the plane of the roof plate 1 and parallel thereto, and is dimensioned in such a way that it completely spans the air passage 6 in the base plate 5, so that at all angles of threat, a ballistic seal is ensured. The air entry can be effected from four sides through the annular channel that is formed.

Further protective and air-conducting elements can be introduced into the intermediate space between base plate 5 and protective plate 7. This will be explained in greater detail in the following.

Figure 4:
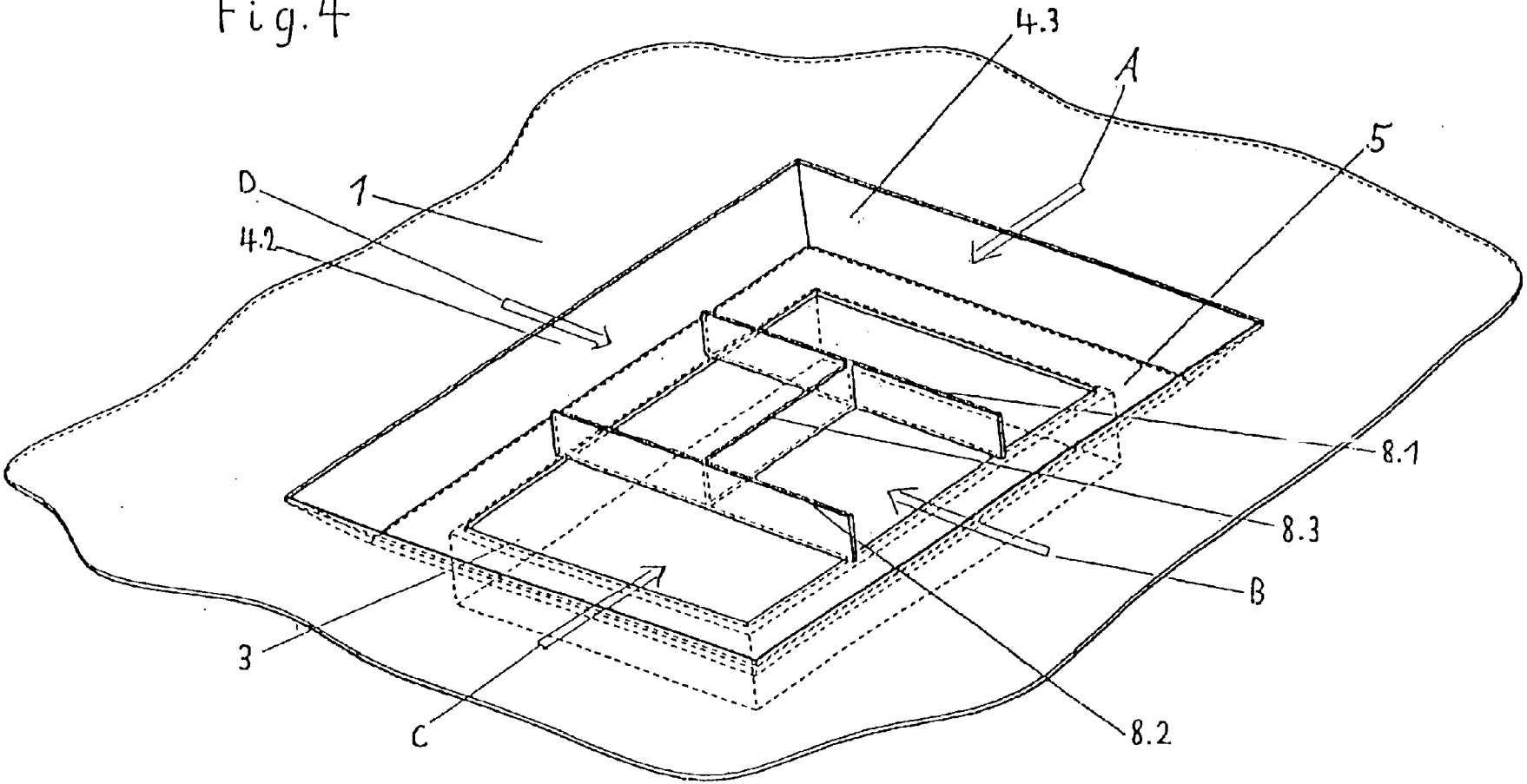
FIG. 4, in an illustration analogous to FIGS. 1 to 3, the roof plate with the base plate inserted and air-conducting plates inserted, but with the protective plate removed.

FIG. 4 illustrates how the space between base plate 5 and protective plate 7 can be divided by air-conducting plates 8.1, 8.2 and 8.3 into a plurality of entry regions for the incoming air, with the entry regions being separated from one another. For this purpose, the air-conducting plates 8.1 to 8.3, when viewed in plan upon the air passage 6, are disposed in an H-shaped manner, whereby the cross piece 8.3 of the H is disposed essentially on a center line of the air passage 6, and the two longitudinal members 8.1 and 8.2 of the H extend in the edge regions of the air passage 6. In this connection, the length of the two longitudinal members 8.1 and 8.2 is greater than the width of the air passage 6. As can be seen in FIG. 4, there thus result four air entry regions into which the air flows in the directions of the arrows A, B, C and D, and in particular in such a way that no mixing together of the air streams, which enter from four directions, occurs, and turbulence, and parasitic air currents, below the protective plate 7 are avoided.

It is, of course, also possible to divide the space between base plate and protective plate by differently arranged air-conducting plates into a plurality of entry regions for the incoming air, which entry regions are separated from one another. Thus, for example, deviating from the position illustrated in FIG. 4, and when viewed in plan upon the air passage, the air-conducting plates can also be arranged in a T-shaped or Y-shaped manner. The important thing is that separated air entry regions result, so that no mixing together of the air streams, which enter from different directions, occurs.

Figure 5:
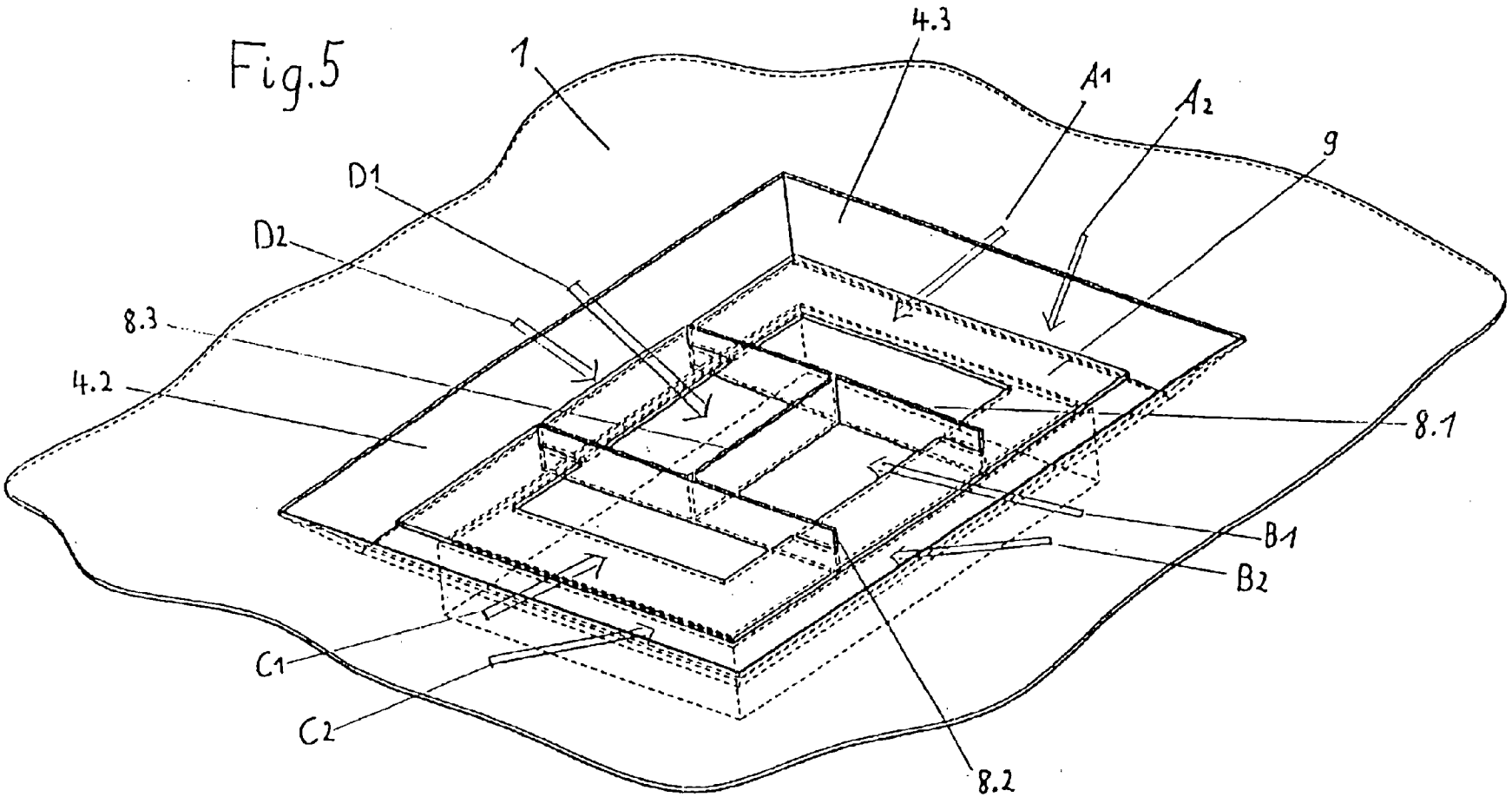
FIG. 5, in an illustration analogous to FIGS. 1 to 4, the roof plate with base plate and intermediate shielding inserted, and protective plate removed.

As can be seen in FIG. 5, an intermediate armor or shielding 9 can furthermore be disposed in the space between the base plate 5 and the protective plate 7 of FIG. 5, with the central region of the intermediate shielding being provided with a further air passage that is disposed over the air passage 6 and that is spaced a certain amount from both the base plate 5 as well as the protective plate 7. The outer dimensions of the intermediate shielding 9 can be the same or greater than the outer dimensions of the protective plate 7, as can be seen from FIG. 6.

Due to the provision of the intermediate shielding 9, the in-flow paths of the air are further split in the vertical direction, depending upon whether the air stream is moved above or below the intermediate shielding 9. As can be seen from FIG. 5, there thus result four upper air streams A1, B1, C1 and D1, and four lower airstreams A2, B2, C2 and D2. In this connection, the partial airstreams A1 to D1 are guided into the inner regions of the air passage 6 between the covering protective plate 7 and the intermediate shielding 9, while the partial airstreams A2 to D2, which extend in the region between the intermediate shielding 9 and the base plate 5, are guided into the outer regions. The intermediate shielding 9 furthermore has the objective of closing off the ballistically weak locations at the edges below the covering protective plate 7.

Figure 6:
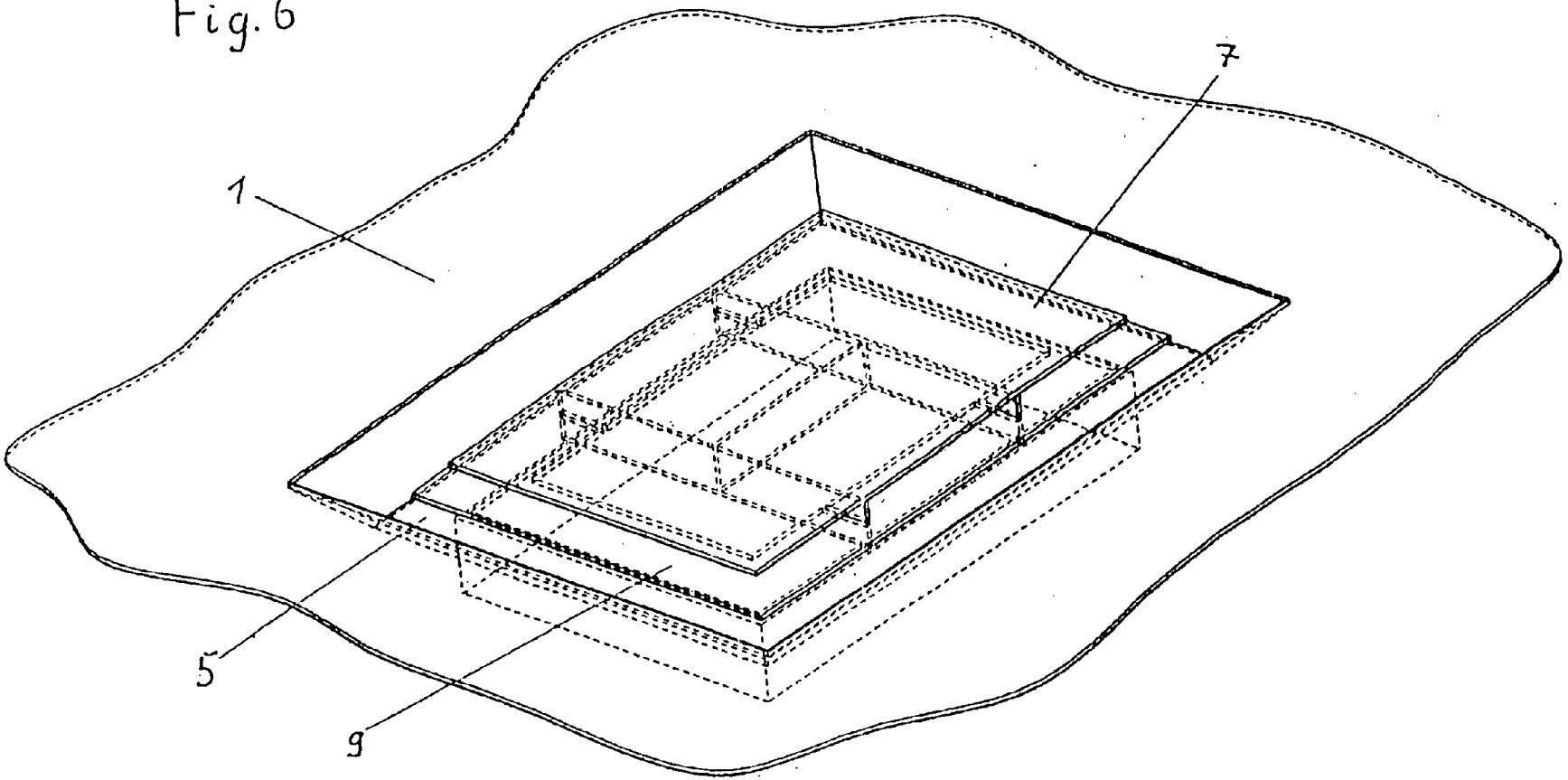
FIG. 6, in an illustration analogous to FIGS. 1 to 5, the roof plate with inserted base plate, intermediate shielding and inserted protective plate.

FIG. 6 shows the ballistically tight and aerodynamically optimized air inlet opening 2 in the surrounding vehicle armor 1. The annular gap between roof plate 1 and protective plate 7 can be covered with an air-permeable, radar-effective cover, or the cover plates 4.1 to 4.4, and the undersides of the covering protective plate 7 as well as of the intermediate shielding 9, can be provided with radar-absorbing coatings.

The specification incorporates by reference the disclosure of German priority document 102 03 021.9 filed Jan. 26, 2002 and PCT/DE03/00056 filed Jan. 10, 2003.

The present invention is, of course, in no way restricted to the specific disclosure of the specification and drawings, but also encompasses any modifications within the scope of the appended claims.

What is claimed is:

1. An armored vehicle having an outer wall in which is disposed an air inlet opening behind which a radiator is positioned in an interior of the vehicle, wherein the air inlet opening is provided with a ballistic protective device comprising:

a base plate that extends essentially parallel to said outer wall and is disposed in said interior of the vehicle in a region between said radiator and said air inlet opening, wherein said base plate has outer dimensions that are equal to or smaller by a prescribed amount than dimensions of said air inlet opening, and wherein said base plate is provided in a central portion thereof with an air passage below which said radiator is positioned;

cover plates that form a closed ring and close off intermediate spaces between outer edges of said base plate and inner edges of said air inlet opening, wherein a recessed area is formed by said base plate and said cover plates; and a protective plate that partially covers said recessed area, wherein dimensions at least along partial portions of outer edges of said protective plate are smaller than said dimensions of said air inlet opening yet greater than dimensions of said air passage in said base plate, and wherein said protective plate is disposed essentially in a plane of said outer wall.

2. An armored vehicle according to claim 1, wherein at least a portion of said cover plates is inclined inwardly at an angle to said central portion of said base plate.

3. An armored vehicle according to claim 1, wherein said air inlet opening and said air passage are embodied as rectangular openings.

4. An armored vehicle according to claim 1, wherein, for separating air streams flowing in from various directions through an annular gap between said outer edges of said protective plate and said inner edges of said air inlet opening, air-conducting plates, which extend essentially perpendicular to said protective plate, are disposed between said base plate and said protective plate.

5. An armored vehicle according to claim 4, wherein said air-conducting plates, when viewed in plan upon said air passage, are disposed in a H-shaped manner, forming a cross piece that extends essentially on a center line of said air passage, and two longitudinal members that extend in edge regions of said air passage.

6. An armored vehicle according to claim 5, wherein said two longitudinal members are longer than a width of said air passage at this location.

7. An armored vehicle according to claim 1, wherein an intermediate shielding, which extends parallel to said protective plate, is disposed between said protective plate and said base plate, and wherein said intermediate shielding, in a central portion thereof, is provided with a further air passage that is disposed essentially over said air passage of said base plate.

8. An armored vehicle according to claim 7, wherein dimensions of said air passage of said intermediate shielding are less than dimensions of said air passage of said base plate.

9. An armored vehicle according to claim 7, wherein outer dimensions of said intermediate shielding are greater by a prescribed amount than outer dimensions of said protective plate.

10. An armored vehicle according to claim 1, wherein an annular gap between said outer edges of said protective plate and said inner edges of said air inlet opening are closed off by an air-permeable, radar-absorbing cover.

11. An armored vehicle according to claim 7, wherein at least one of inner surfaces of said cover plates, an underside of said protective plate, and an underside of said intermediate shielding is provided with a radar-absorbing coating.

* * * * *

UNITED STATES PATENT AND TRADEMARK OFFICE

CERTIFICATE OF CORRECTION

PATENT NO. : 6,923,107 B2
DATED : August 2, 2005
INVENTOR(S) : Zurek et al.

It is certified that error appears in the above-identified patent and that said Letters Patent is hereby corrected as shown below:

Title page,
Item [54], Title, should read as follows:
-- ARMORED VEHICLE, ESPECIALLY COMBAT VEHICLE --.

Signed and Sealed this

Eleventh Day of October, 2005

JON W. DUDAS
*Director of the United States Patent and Trademark Office*